US011812789B2

(12) United States Patent
Marubashi

(10) Patent No.: US 11,812,789 B2
(45) Date of Patent: Nov. 14, 2023

(54) POWER SUPPLY UNIT FOR AEROSOL GENERATION DEVICE

(71) Applicant: Japan Tobacco Inc., Tokyo (JP)

(72) Inventor: Keiji Marubashi, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 0 days.

(21) Appl. No.: 17/489,800

(22) Filed: Sep. 30, 2021

(65) Prior Publication Data

US 2022/0095690 A1 Mar. 31, 2022

(30) Foreign Application Priority Data

Sep. 30, 2020 (JP) ..... 2020-166306

(51) Int. Cl.

| | |
|---|---|
| ***A24F 40/57*** | (2020.01) |
| ***A24F 40/53*** | (2020.01) |
| ***A24F 40/10*** | (2020.01) |
| ***A24F 40/46*** | (2020.01) |
| ***A24F 40/20*** | (2020.01) |
| ***A24F 40/30*** | (2020.01) |

(52) U.S. Cl.

CPC ..... *A24F 40/57* (2020.01); *A24F 40/10* (2020.01); *A24F 40/20* (2020.01); *A24F 40/30* (2020.01); *A24F 40/46* (2020.01); *A24F 40/53* (2020.01)

(58) Field of Classification Search

CPC ..... A24F 40/57; A24F 40/30

See application file for complete search history.

(56) References Cited

U.S. PATENT DOCUMENTS

| | | | | |
|---|---|---|---|---|
| 11,202,342 | B2 * | 12/2021 | Takeuchi | H02J 7/0063 |
| 2013/0319435 | A1 | 12/2013 | Flick | |
| 2013/0319440 | A1 * | 12/2013 | Capuano | A61M 15/06 131/329 |
| 2014/0020693 | A1 | 1/2014 | Cochand et al. | |

(Continued)

FOREIGN PATENT DOCUMENTS

| | | | |
|---|---|---|---|
| CN | 109198724 | A | 1/2019 |
| EP | 3 871 524 | A1 | 9/2021 |

(Continued)

OTHER PUBLICATIONS

Notice of Reasons for Refusal dated Jan. 12, 2021, received for Japanese Patent Application No. 2020-166306, 5 pages.

(Continued)

*Primary Examiner* — Anthony Calandra

(74) *Attorney, Agent, or Firm* — XSENSUS LLP

(57) ABSTRACT

A power supply unit for an aerosol generation device through which flavored aerosol is inhaled includes: a power supply configured to discharge electricity to an atomizer configured to atomize an aerosol source and a heater configured to heat a flavor source that adds a flavor component to aerosol generated from the aerosol source; and a processing device configured to acquire a flow rate of inhalation of a user. When the inhalation of the user is detected, the processing device discharges electricity from the power supply to the atomizer so as to generate aerosol. The processing device controls power to be discharged to the heater based on the flow rate such that a concentration of a flavor component contained in a fluid inhaled by the user becomes a target value.

2 Claims, 10 Drawing Sheets

(56) References Cited

U.S. PATENT DOCUMENTS

| | | | | |
|---|---|---|---|---|
| 2015/0327596 | A1* | 11/2015 | Alarcon | H04L 67/22 131/328 |
| 2017/0071251 | A1 | 3/2017 | Goch | |
| 2017/0135401 | A1 | 5/2017 | Dickens | |
| 2017/0258142 | A1* | 9/2017 | Hatton | A24F 40/50 |
| 2017/0360094 | A1* | 12/2017 | Kuczaj | A61M 15/06 |
| 2018/0146710 | A1* | 5/2018 | Bessant | A24F 40/40 |
| 2018/0360122 | A1 | 12/2018 | Aoun et al. | |
| 2020/0000143 | A1* | 1/2020 | Anderson | G06F 3/16 |
| 2020/0086068 | A1 | 3/2020 | Lee et al. | |
| 2020/0093177 | A1 | 3/2020 | Han et al. | |
| 2020/0093185 | A1 | 3/2020 | Lim | |
| 2020/0093187 | A1 | 3/2020 | Dickens | |
| 2020/0154765 | A1 | 5/2020 | Lee et al. | |
| 2020/0154766 | A1 | 5/2020 | Jeong | |
| 2020/0154768 | A1 | 5/2020 | Han et al. | |
| 2020/0154772 | A1 | 5/2020 | Lim et al. | |
| 2020/0154773 | A1 | 5/2020 | Lim et al. | |
| 2020/0154775 | A1 | 5/2020 | Lee et al. | |
| 2020/0154776 | A1 | 5/2020 | Lee et al. | |
| 2020/0163380 | A1 | 5/2020 | Lee et al. | |
| 2020/0170298 | A1 | 6/2020 | Lee et al. | |
| 2020/0187555 | A1 | 6/2020 | Lee | |
| 2020/0221773 | A1 | 7/2020 | An | |
| 2020/0221782 | A1 | 7/2020 | Lim | |
| 2020/0229501 | A1 | 7/2020 | Han et al. | |
| 2020/0237005 | A1 | 7/2020 | Lim et al. | |
| 2020/0237014 | A1 | 7/2020 | Lee et al. | |
| 2020/0268055 | A1 | 8/2020 | An | |
| 2020/0281273 | A1 | 9/2020 | Kim et al. | |
| 2020/0288778 | A1 | 9/2020 | Kim et al. | |
| 2020/0297029 | A1* | 9/2020 | Shimizu | A24F 40/40 |
| 2020/0305512 | A1 | 10/2020 | Lim et al. | |
| 2020/0323264 | A1 | 10/2020 | Kim et al. | |
| 2020/0329772 | A1 | 10/2020 | Kim et al. | |
| 2020/0337374 | A1 | 10/2020 | Han et al. | |
| 2020/0345076 | A1 | 11/2020 | Lim et al. | |
| 2020/0352229 | A1 | 11/2020 | Lee | |
| 2020/0352231 | A1 | 11/2020 | Han et al. | |
| 2020/0352235 | A1 | 11/2020 | Lee et al. | |
| 2020/0352244 | A1 | 11/2020 | Lim et al. | |
| 2020/0359681 | A1 | 11/2020 | Han et al. | |
| 2020/0359682 | A1 | 11/2020 | Han et al. | |
| 2020/0359693 | A1 | 11/2020 | Lee et al. | |
| 2020/0359695 | A1 | 11/2020 | Lim | |
| 2020/0359696 | A1 | 11/2020 | Lim | |
| 2020/0359698 | A1 | 11/2020 | Lim et al. | |
| 2021/0106051 | A1 | 4/2021 | Han et al. | |
| 2021/0106052 | A1 | 4/2021 | Lee et al. | |
| 2021/0127742 | A1 | 5/2021 | Kim et al. | |
| 2021/0127748 | A1 | 5/2021 | Lim et al. | |
| 2021/0169148 | A1 | 6/2021 | Nakano et al. | |

FOREIGN PATENT DOCUMENTS

| | | | |
|---|---|---|---|
| JP | 5959532 | B2 | 8/2016 |
| JP | 5999716 | B2 | 9/2016 |
| JP | 2017-511703 | A | 4/2017 |
| JP | 6295347 | B2 | 3/2018 |
| JP | 2020-526231 | A | 8/2020 |
| JP | 6756063 | B1 | 9/2020 |
| WO | 2019/017654 | A2 | 1/2019 |
| WO | 2020/039589 | A1 | 2/2020 |

OTHER PUBLICATIONS

Decision to Grant dated Apr. 27, 2021, received for Japanese Patent Application No. 2020-166306, 5 pages.

Communication pursuant to Article 94(3) EPC dated Nov. 11, 2022, in corresponding European Patent Application 21 199 811.7, 4 pp.

* cited by examiner

POWER SUPPLY UNIT FOR AEROSOL GENERATION DEVICE

CROSS-REFERENCE TO RELATED APPLICATION

This application is based upon and claims the benefit of priority from prior Japanese patent application No. 2020-166306, filed on Sep. 30, 2020, the entire contents of which are incorporated herein by reference.

TECHNICAL FIELD

The present invention relates to a power supply unit for an aerosol generation device.

SUMMARY OF INVENTION

An object of the present invention is to facilitate stabilization of a flavor as compared with the case where the amount of generated aerosol is controlled only in accordance with the cumulative air flow rate.

According to an aspect of the present invention, there is provided a power supply unit for an aerosol generation device through which flavored aerosol is inhaled, the power supply unit including: a power supply configured to discharge electricity to an atomizer configured to atomize an aerosol source and a heater configured to heat a flavor source that adds a flavor component to aerosol generated from the aerosol source; and a processing device configured to acquire a flow rate of inhalation of a user, where: when the inhalation of the user is detected, the processing device discharges electricity from the power supply to the atomizer so as to generate aerosol; and the processing device controls power to be discharged to the heater based on the flow rate such that a concentration of a flavor component contained in a fluid inhaled by the user becomes a target value.

According to the aspect of the present invention, the stabilization of the flavor can be facilitated as compared with the case where the amount of generated aerosol is controlled only in accordance with the cumulative air flow rate.

DESCRIPTION OF EMBODIMENTS

Hereinafter, an aerosol generation device 1 that is an embodiment of an aerosol generation device of the present invention will be described with reference to FIGS. 1 to 6.

(Aerosol Generation Device)

Figure 1:
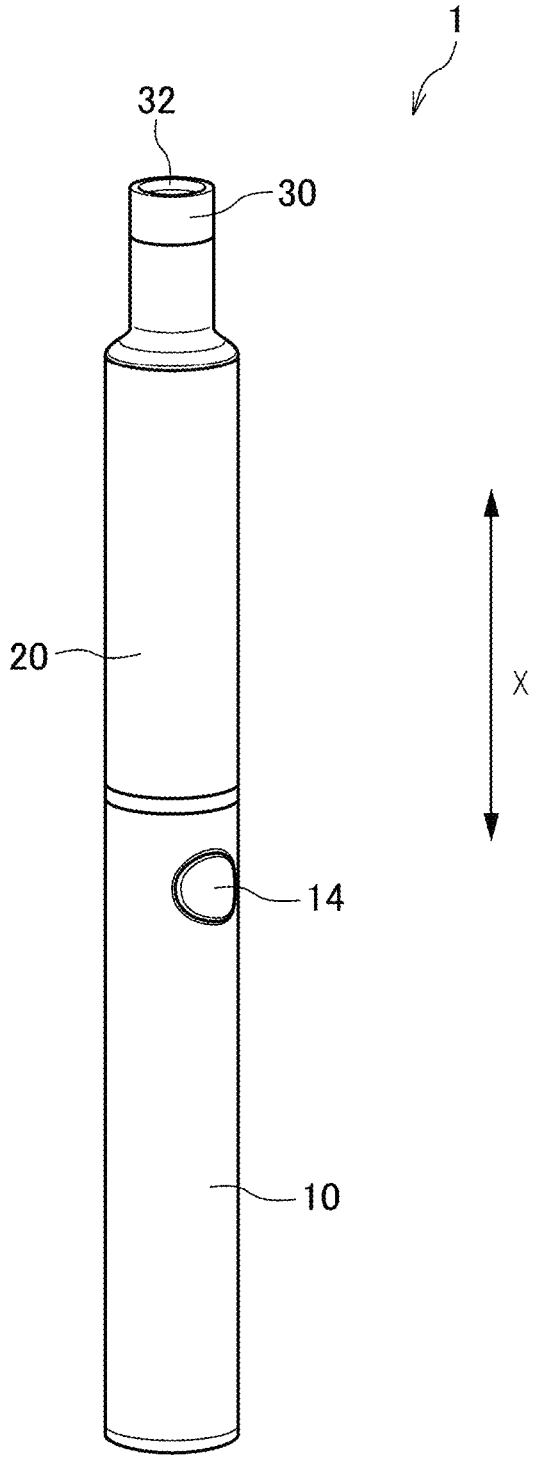
FIG. 1 is a perspective view schematically showing a schematic configuration of an aerosol generation device.
Figure 2:
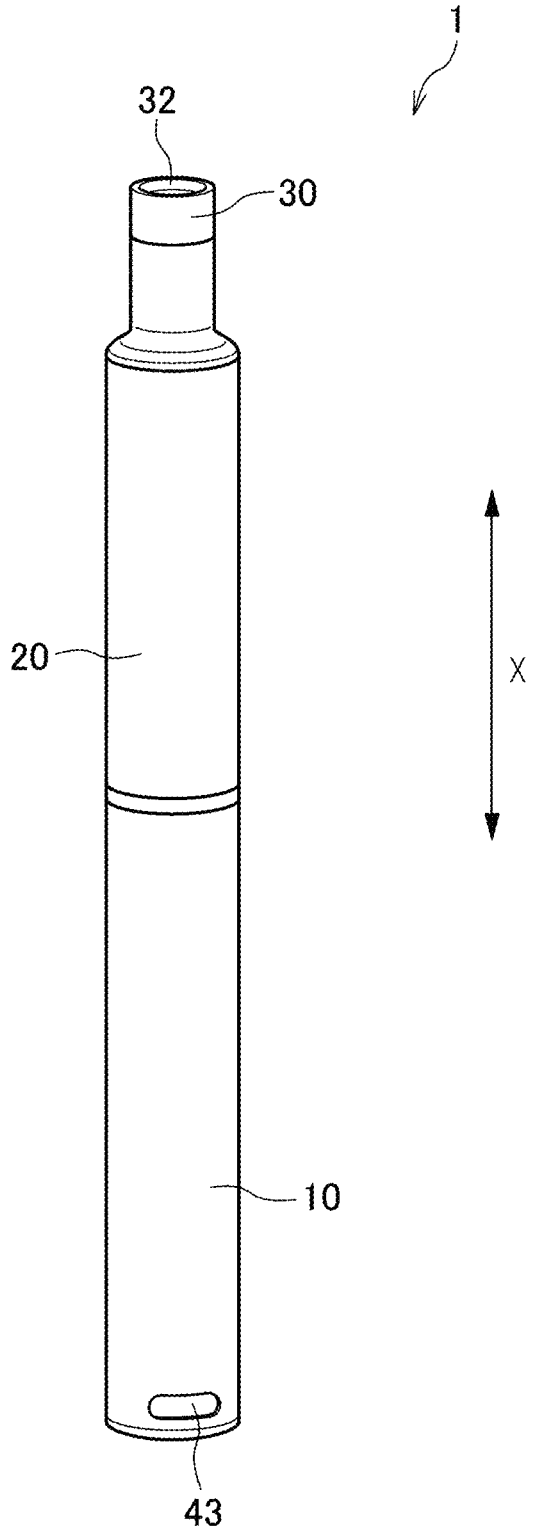
FIG. 2 is another perspective view of the aerosol generation device shown in FIG. 1.

The aerosol generation device 1 is an instrument for generating aerosol to which a flavor component is added without burning and allowing the aerosol to be inhaled, and has a rod shape that extends along a predetermined direction (hereinafter referred to as a longitudinal direction X) as shown in FIGS. 1 and 2.

In the aerosol generation device 1, a power supply unit 10, a first cartridge 20, and a second cartridge 30 are provided in such an order along the longitudinal direction X.

The first cartridge 20 is attachable to and detachable from (in other words, replaceable relative to) the power supply unit 10. The second cartridge 30 is attachable to and detachable from (in other words, replaceable relative to) the first cartridge 20.

Figure 3:
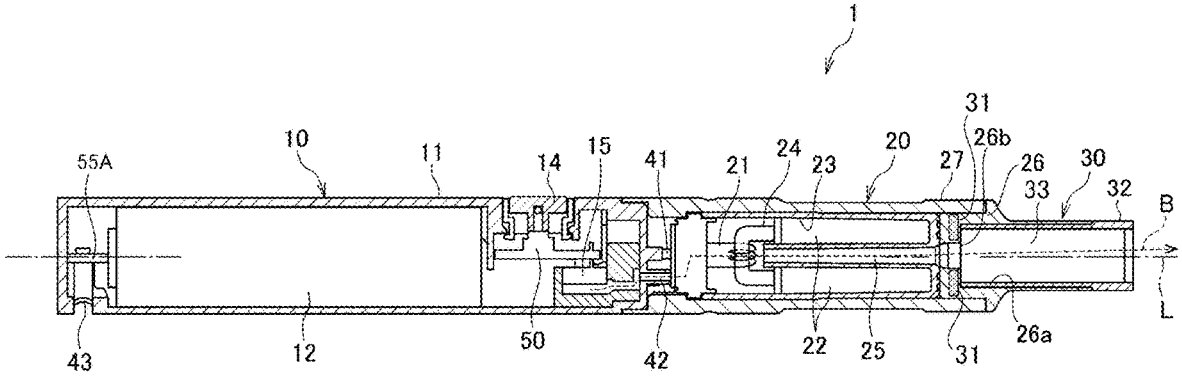
FIG. 3 is a cross-sectional view of the aerosol generation device shown in FIG. 1.

As shown in FIG. 3, the first cartridge 20 is provided with a first load 21 and a second load 31.

As shown in FIG. 1, an overall shape of the aerosol generation device 1 is not limited to a shape in which the power supply unit 10, the first cartridge 20, and the second cartridge 30 are arranged in a line.

As long as the first cartridge 20 and the second cartridge 30 are replaceable relative to the power supply unit 10, any shape such as a substantially box shape can be adopted.

(Power Supply Unit)

Figure 4:
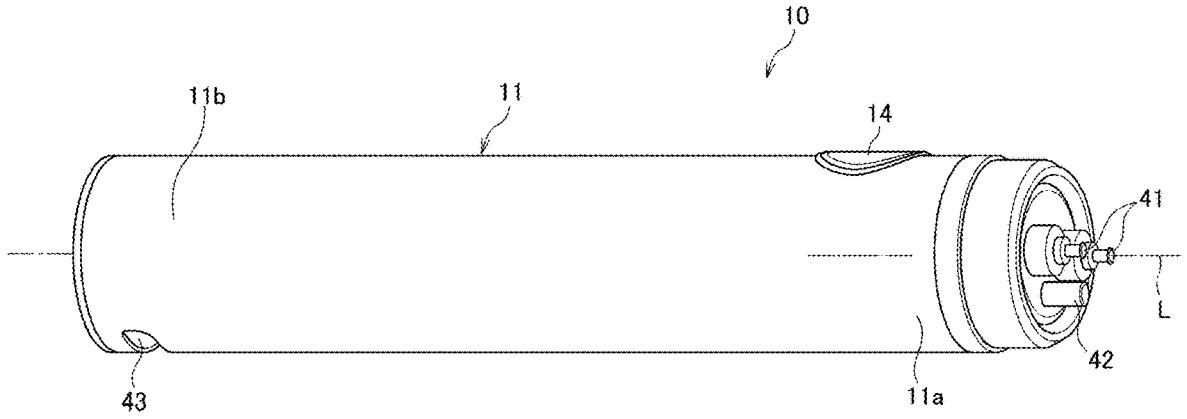
FIG. 4 is a perspective view of a power supply unit of the aerosol generation device shown in FIG. 1.
Figure 5:
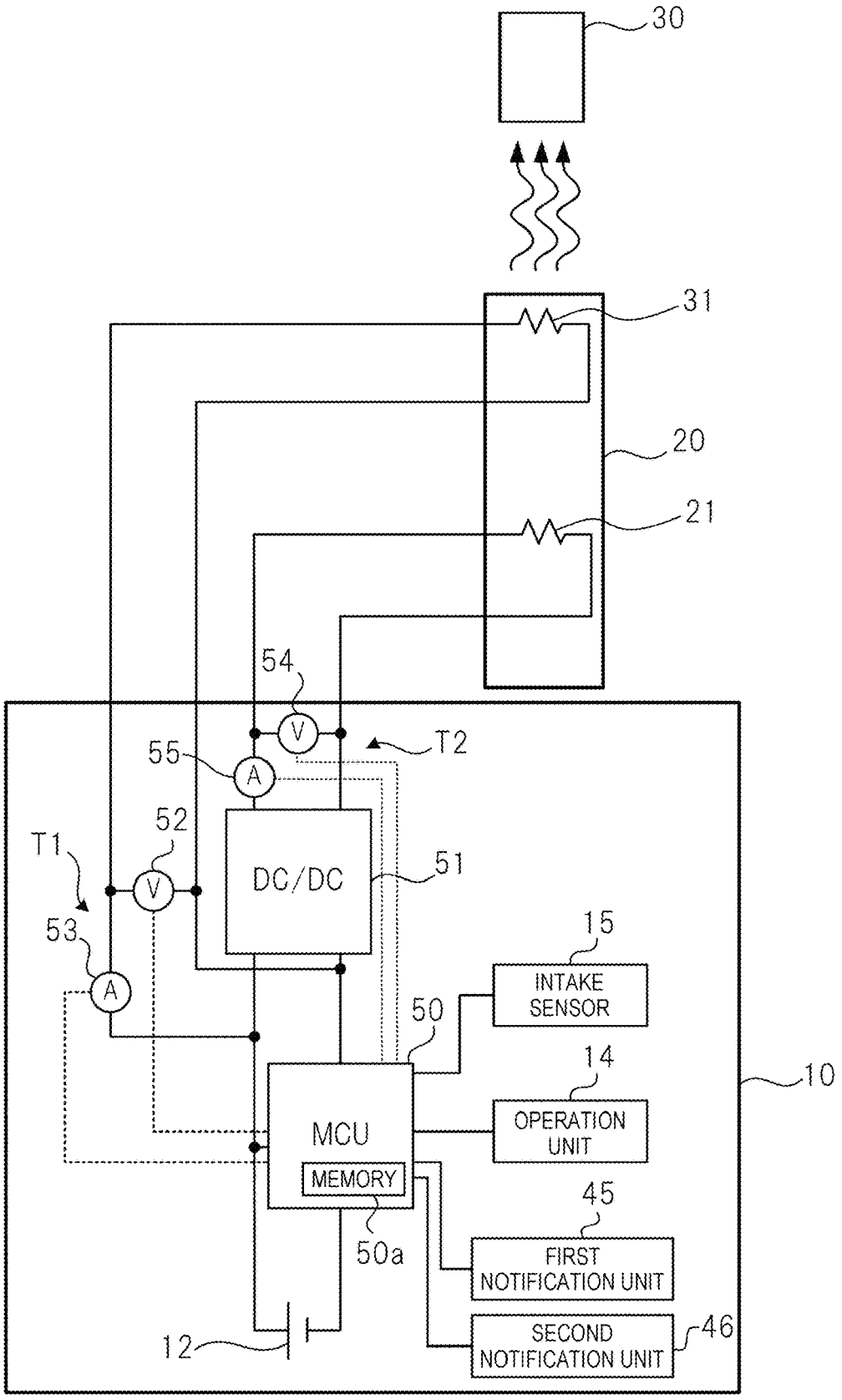
FIG. 5 is a schematic view showing a hardware configuration of the aerosol generation device shown in FIG. 1.

As shown in FIGS. 3, 4, and 5, inside a cylindrical power supply unit case 11, the power supply unit 10 accommodates a power supply 12, a charging IC 55A, a micro controller unit (MCU) 50, a DC/DC converter 51, an intake sensor 15, a temperature detection element T1 including a voltage sensor 52 and a current sensor 53, a temperature detection element T2 including a voltage sensor 54 and a current sensor 55, a first notification unit 45, and a second notification unit 46.

The power supply 12 is a rechargeable secondary battery, an electric double layer capacitor, or the like, and is preferably a lithium-ion secondary battery. An electrolyte of the power supply 12 may be formed of one or a combination of a gel-like electrolyte, an electrolytic solution, a solid electrolyte, and an ionic liquid.

As shown in FIG. 5, the MCU 50 is connected to various sensor devices such as the intake sensor 15, the voltage sensor 52, the current sensor 53, the voltage sensor 54, and the current sensor 55, the DC/DC converter 51, an operation unit 14, the first notification unit 45, and the second notification unit 46, and performs various types of control of the aerosol generation device 1.

Specifically, the MCU 50 is mainly constituted by a processor, and further includes a memory 50*a* that is constituted by a storage medium such as a random access memory (RAM) necessary for an operation of the processor and a read only memory (ROM) that stores various types of information. Specifically, the processor in the present specification is an electric circuit in which circuit elements such as semiconductor elements are combined.

As shown in FIG. 4, a discharging terminal 41 is provided on a top portion 11*a* positioned on one end side (the side of the first cartridge 20) of the power supply unit case 11 in the longitudinal direction X. The discharging terminal 41 is provided so as to protrude from an upper surface of the top portion 11*a* toward the first cartridge 20, and is configured to be electrically connectable to each of the first load 21 and the second load 31 of the first cartridge 20.

In addition, an air supply unit 42 that supplies air to the first load 21 of the first cartridge 20 is provided in the vicinity of the discharging terminal 41 on the upper surface of the top portion 11*a*.

A charging terminal 43 that can be electrically connected to an external power supply (not shown) is provided in a bottom portion 11*b* positioned on the other end side (a side opposite to the first cartridge 20) of the power supply unit case 11 in the longitudinal direction X. The charging terminal 43 is provided in a side surface of the bottom portion 11*b*, and can be connected to, for example, a universal serial bus (USB) terminal, a micro USB terminal, or the like.

The charging terminal 43 may be a power reception unit that can receive power transmitted from the external power supply in a wireless manner. In such a case, the charging terminal 43 (power reception unit) may be constituted by a power reception coil. A method of wireless power transfer in this case may be an electromagnetic induction type method, a magnetic resonance type method, or a combination of the electromagnetic induction type method and the magnetic resonance type method. The charging terminal 43 may be a power reception unit that can receive power transmitted from the external power supply in a contactless manner. As another example, the charging terminal 43 can be connected to a USB terminal or a micro USB terminal, and may include the power reception unit described above.

The power supply unit case 11 is provided with the operation unit 14 that can be operated by a user on the side surface of the top portion 11*a* so as to face a side opposite to the charging terminal 43. The operation unit 14 is constituted by a button-type switch, a touch panel, or the like. When a predetermined activation operation is performed by the operation unit 14 in a state where the power supply unit 10 is power-off, the operation unit 14 outputs an activation command of the power supply unit 10 to the MCU 50. When the MCU 50 acquires the activation command, the MCU 50 activates the power supply unit 10.

As shown in FIG. 3, the intake sensor 15 that detects a puff (inhalation) operation is provided in the vicinity of the operation unit 14. The power supply unit case 11 is provided with an air intake port (not shown) through which outside air is taken into the power supply unit case 11. The air intake port may be provided around the operation unit 14, or may be provided around the charging terminal 43.

The intake sensor 15 is configured to output a value of a pressure (internal pressure) change in the power supply unit 10 caused by inhalation of the user through an inhalation port 32 described later. The intake sensor 15 is, for example, a pressure sensor that outputs an output value (for example, a voltage value or a current value) corresponding to internal pressure that changes in accordance with a flow rate of air inhaled from an air intake port toward the inhalation port 32. The intake sensor 15 may output an analog value, or may output a digital value converted from the analog value.

In order to compensate for pressure to be detected, the intake sensor 15 may include a temperature sensor that detects a temperature (outside air temperature) of an environment in which the power supply unit 10 is placed. The intake sensor 15 may be constituted by a condenser microphone or the like instead of a pressure sensor.

When the puff operation is performed and the output value of the intake sensor 15 is equal to or higher than an output threshold value, the MCU 50 determines that an aerosol generation request (an atomization command of an aerosol source 22 to be described later) has been made, and thereafter, when the output value of the intake sensor 15 falls below the output threshold value, the MCU 50 determines that the aerosol generation request has ended. In the aerosol generation device 1, for a purpose of preventing overheating of the first load 21 or the like, when a period during which the aerosol generation request is made reaches an upper limit value $t_{upper}$ (for example, 2.4 seconds), it is determined that the aerosol generation request has ended regardless of the output value of the intake sensor 15.

Instead of the intake sensor 15, the aerosol generation request may be detected based on an operation of the operation unit 14. For example, when the user performs a predetermined operation on the operation unit 14 in order to start inhaling aerosol, the operation unit 14 may output a signal indicating the aerosol generation request to the MCU 50.

When it is determined that the aerosol generation request is started, the MCU 50 acquires a flow rate of the inhalation of the user. This flow rate is a flow rate of a fluid that flows in from the air intake port of the power supply unit 10, passes through inside of the first cartridge 20 and the second cartridge 30, and is transported to a mouth of the user due to the inhalation of the user. A unit of the flow rate is, for example, "ml/minute". The fluid to be transported to the mouth of the user is a combination of aerosol generated from the aerosol source 22, a flavor component added to the aerosol by a flavor source 33, and air taken in from the air intake port.

As a method of acquiring the flow rate, a method of calculating the flow rate based on the output value of the intake sensor, a method of providing a flow rate sensor inside the power supply unit 10 or the first cartridge 20 and detecting the flow rate by the flow rate sensor, or the like can be adopted.

The charging IC 55A is disposed close to the charging terminal 43, and controls charging of power input from the charging terminal 43 to the power supply 12. The charging IC 55A may be disposed in the vicinity of the MCU 50.

(First Cartridge)

As shown in FIG. 3, inside a cylindrical cartridge case 27, the first cartridge 20 includes a reservoir 23 constituting a storage portion that stores the aerosol source 22, the first load 21 constituting an atomizer that atomizes the aerosol source 22 so as to generate aerosol, a wick 24 that draws the aerosol source 22 from the reservoir 23 to a position of the first load 21, an aerosol flow path 25 constituting a cooling passage that sets a particle size of the aerosol generated by atomization of the aerosol source 22 to a size suitable for inhalation, an end cap 26 that accommodates a part of the second cartridge 30, and the second load 31 that is provided in the end cap 26 and configured to heat the second cartridge 30.

The reservoir 23 is partitioned to surround a periphery of the aerosol flow path 25, and stores the aerosol source 22. A porous body, such as a resin web or cotton, may be accommodated in the reservoir 23, and the aerosol source 22 may be impregnated in the porous body. The reservoir 23 may only store the aerosol source 22 without accommodating the porous body such as the resin web or cotton. The aerosol source 22 includes a liquid such as glycerin, propylene glycol or water.

The wick 24 is a liquid holding member that draws the aerosol source 22 from the reservoir 23 to the position of the first load 21 by using a capillary phenomenon. The wick 24 constitutes a holding portion that holds the aerosol source 22 supplied from the reservoir 23 at a position where the aerosol source 22 can be atomized by the first load 21. The wick 24 is formed of, for example, glass fiber or porous ceramic.

The first load 21 atomizes the aerosol source 22 by heating the aerosol source 22 without burning by power supplied from the power supply 12 via the discharging terminal 41. In principle, as the power supplied from the power supply 12 to the first load 21 increases, an amount of the atomized aerosol source increases. The first load 21 is constituted by an electric heating wire (coil) wound at a predetermined pitch.

The first load 21 may be any element that can generate aerosol by heating the aerosol source 22 and atomizing the aerosol source 22. The first load 21 is, for example, a heat generating element. Examples of the heat generating element include a heat generating resistor, a ceramic heater, an induction heating type heater, and the like.

It is preferable that a load in which a temperature and an electric resistance value have a correlation is used as the first load 21. As the first load 21, for example, a load having positive temperature coefficient (PTC) characteristics in which an electric resistance value increases as a temperature increases is used.

The aerosol flow path 25 is downstream of the first load 21 and is provided on a center line L of the power supply unit 10. The end cap 26 includes: a cartridge accommodating portion 26*a* that accommodates a part of the second cartridge 30; and a communication path 26*b* that communicates the aerosol flow path 25 and the cartridge accommodating portion 26*a*.

The second load 31 is embedded in the cartridge accommodating portion 26*a*. The second load 31 heats the second cartridge 30 (more specifically, the flavor source 33 included in the second cartridge 30) accommodated in the cartridge accommodating portion 26*a* by the power supplied from the power source 12 via the discharging terminal 41. The second load 31 is constituted by, for example, an electric heating wire (coil) wound at a predetermined pitch.

The second load 31 may be any element that can heat the second cartridge 30. The second load 31 is, for example, a heat generating element. Examples of the heat generating element include a heat generating resistor, a ceramic heater, an induction heating type heater, and the like. It is preferable that a load in which a temperature and an electric resistance value have a correlation is used as the second load 31. As the second load 31, for example, a load having PTC characteristics is used.

(Second Cartridge)

The second cartridge 30 stores the flavor source 33. When the second cartridge 30 is heated by the second load 31, the flavor source 33 is heated. The second cartridge 30 is detachably accommodated in the cartridge accommodating portion 26*a* provided in the end cap 26 of the first cartridge 20. An end portion, which is located on a side opposite to the side of the first cartridge 20, of the second cartridge 30 serves as the user inhalation port 32. The inhalation port 32 is not limited to be formed integrally with the second cartridge 30, and may also be detachable from the second cartridge 30. By forming the inhalation port 32 separately from the power supply unit 10 and the first cartridge 20 in this way, the inhalation port 32 can be kept hygienic.

The second cartridge 30 adds a flavor component to the aerosol by passing the aerosol generated by atomizing the aerosol source 22 by the first load 21 through the flavor source 33. Chopped tobacco or a molded body obtained by molding a tobacco raw material into particles can be used as a raw material piece that constitutes the flavor source 33. The flavor source 33 may also be constituted by a plant other than tobacco (for example, mint, Chinese herb, herb, or the like). A fragrance such as menthol may also be added to the flavor source 33.

In the aerosol generation device 1, the aerosol source 22 and the flavor source 33 can generate aerosol to which a flavor component is added. That is, the aerosol source 22 and the flavor source 33 constitute an aerosol generation source that generates the aerosol.

The aerosol generation source of the aerosol generation device 1 is a portion that is replaced and used by the user. The portion is provided to the user, for example, as a set of one first cartridge 20 and one or a plurality of (for example, five) second cartridges 30. The first cartridge 20 and the second cartridge 30 may be integrated into one cartridge.

In the aerosol generation device 1 configured as described above, as indicated by an arrow B in FIG. 3, air that flows in from the air intake port (not shown) provided in the power supply unit case 11 passes through the vicinity of the first load 21 of the first cartridge 20 from the air supply unit 42. The first load 21 atomizes the aerosol source 22 drawn from the reservoir 23 by the wick 24. Aerosol generated by atomization flows through the aerosol flow path 25 together with the air that flows in from the intake port, and is supplied to the second cartridge 30 via the communication path 26*b*. The aerosol supplied to the second cartridge 30 is passed through the flavor source 33 so as to add a flavor component thereto, and is supplied to the inhalation port 32.

The aerosol generation device 1 is also provided with the first notification unit 45 and the second notification unit 46 that notify the user of various types of information (see FIG. 5). The first notification unit 45 is configured to perform notification that acts on a tactile sense of the user, and is constituted by a vibrating element such as a vibrator. The second notification unit 46 is configured to perform notification that acts on a visual sense of the user, and is constituted by a light-emitting element such as a light emitting diode (LED). As the notification unit that notifies various types of information, a sound output element may be further provided to perform notification that acts on an auditory sense of the user. The first notification unit 45 and the second notification unit 46 may be provided in any of the power supply unit 10, the first cartridge 20, and the second cartridge 30, and are preferably provided in the power supply unit 10. For example, a configuration in which a periphery of the operation unit 14 is light-transmissive and light is emitted by a light-emitting element such as an LED is employed.

(Details of Power Supply Unit)

As shown in FIG. 5, the DC/DC converter 51 is connected between the first load 21 and the power supply 12 in a state where the first cartridge 20 is mounted on the power supply unit 10. The MCU 50 is connected between the DC/DC converter 51 and the power supply 12. The second load 31 is connected between the MCU 50 and the DC/DC converter 51 in a state where the first cartridge 20 is mounted on the power supply unit 10. Accordingly, in the power supply unit 10, a series circuit of the DC/DC converter 51 and the first load 21 and the second load 31 are connected in parallel to the power supply 12 in a state where the first cartridge 20 is mounted. A DC/DC converter different from the DC/DC converter 51 may be further provided between the second load 31 and the MCU 50.

The DC/DC converter 51 is a booster circuit that can boost an input voltage, and is configured to be capable of supplying a voltage obtained by boosting the input voltage or the input voltage to the first load 21. Since power supplied to the first load 21 can be adjusted by the DC/DC converter 51, an amount of the aerosol source 22 atomized by the first load 21 can be controlled. As the DC/DC converter 51, for example, a switching regulator that converts an input voltage into a desired output voltage by controlling on/off time of a switching element while monitoring an output voltage can be used. When the switching regulator is used as the DC/DC converter 51, the input voltage can also be output directly without being boosted by controlling the switching element.

The processor of the MCU 50 is configured to be capable of acquiring a temperature of the flavor source 33 and a temperature of the second load 31 in order to control discharging to the second load 31. Further, the processor of the MCU 50 is preferably configured to be capable of acquiring a temperature of the first load 21. The temperature of the first load 21 can be used to prevent overheating of the first load 21 or the aerosol source 22, and to precisely control an amount of the aerosol source 22 atomized by the first load 21.

The voltage sensor 52 measures and outputs a value of a voltage applied to the second load 31. The current sensor 53 measures and outputs a value of a current that flows through the second load 31. Output of the voltage sensor 52 and output of the current sensor 53 are input to the MCU 50. The processor of the MCU 50 acquires a resistance value of the second load 31 based on the output of the voltage sensor 52 and the output of the current sensor 53, and acquires the temperature of the second load 31 corresponding to the resistance value. The temperature of the second load 31 does not exactly coincide with the temperature of the flavor source 33 heated by the second load 31, and can be regarded as substantially the same as the temperature of the flavor source 33.

If a constant current flows to the second load 31 when the resistance value of the second load 31 is acquired, the current sensor 53 is unnecessary in the temperature detection element T1. Similarly, if a constant voltage is applied to the second load 31 when the resistance value of the second load 31 is acquired, the voltage sensor 52 is unnecessary in the temperature detection element T1.

Figure 6:
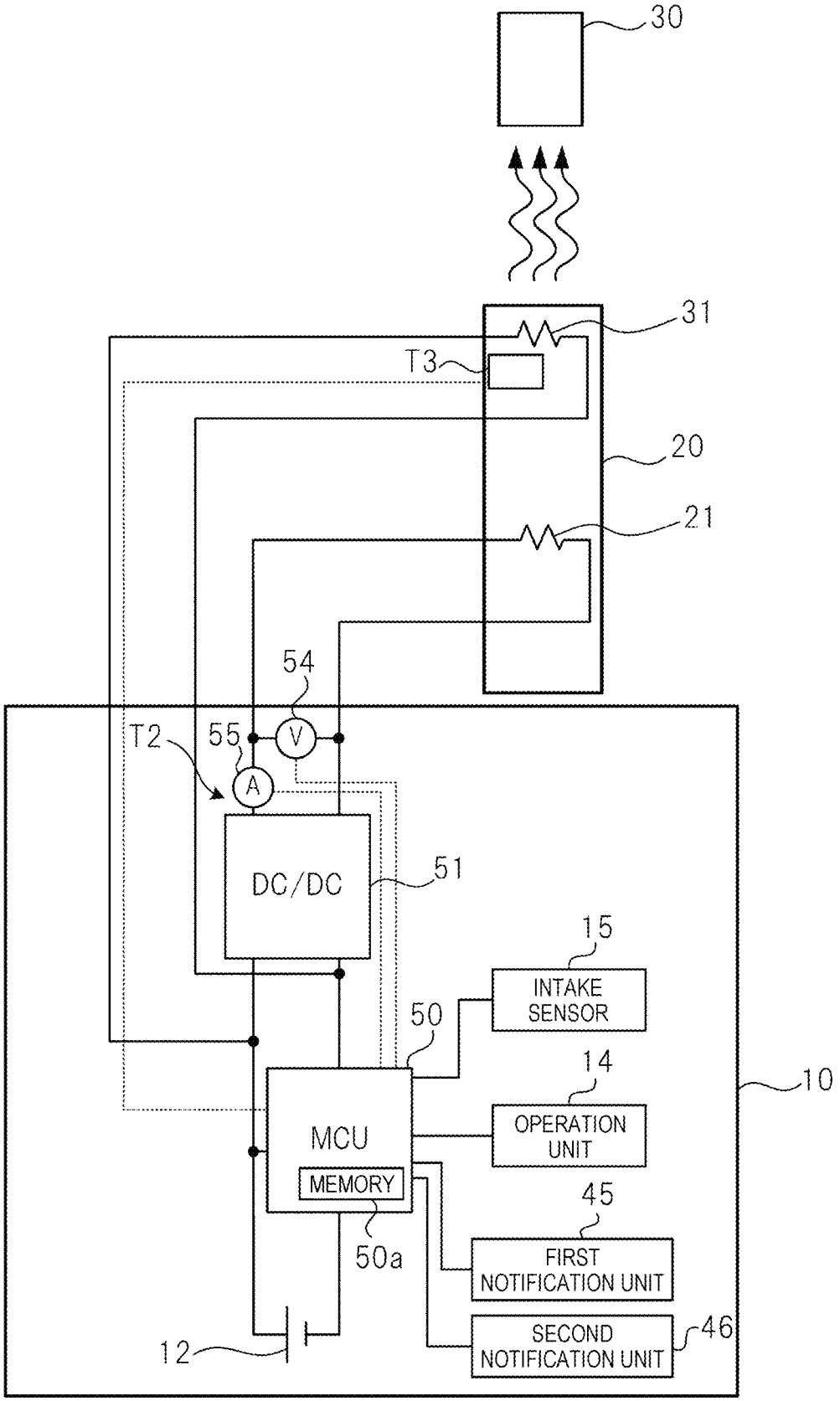
FIG. 6 is a schematic view showing a modification of the hardware configuration of the aerosol generation device shown in FIG. 1.

As shown in FIG. 6, instead of the temperature detection element T1, the first cartridge 20 may be provided with a temperature detection element T3 configured to detect a temperature of the second cartridge 30 or the second load 31. The temperature detection element T3 is constituted by, for example, a thermistor disposed in the vicinity of the second cartridge 30 or the second load 31. In the configuration of FIG. 6, the processor of the MCU 50 acquires the temperature of the second load 31 or the temperature of the second cartridge 30 (in other words, the temperature of the flavor source 33) based on output of the temperature detection element T3.

As shown in FIG. 6, since the temperature of the flavor source 33 is acquired by using the temperature detection element T3, the temperature of the flavor source 33 can be acquired more accurately as compared with a case where the temperature of the flavor source 33 is acquired by using the temperature detection element T1 shown in FIG. 5. The temperature detection element T3 may also be mounted on the second cartridge 30. According to the configuration shown in FIG. 6 in which the temperature detection element T3 is mounted on the first cartridge 20, a manufacturing cost of the second cartridge 30 that has highest replacement frequency in the aerosol generation device 1 can be reduced.

As shown in FIG. 5, when the temperature of the flavor source 33 is acquired by using the temperature detection element T1, the temperature detection element T1 can be provided in the power supply unit 10 that has lowest replacement frequency in the aerosol generation device 1. Therefore, manufacturing costs of the first cartridge 20 and the second cartridge 30 can be reduced.

The voltage sensor 54 measures and outputs a value of a voltage applied to the first load 21. The current sensor 55 measures and outputs a value of a current that flows through the first load 21. Output of the voltage sensor 54 and output of the current sensor 55 are input to the MCU 50. The processor of the MCU 50 acquires a resistance value of the first load 21 based on the output of the voltage sensor 54 and the output of the current sensor 55, and acquires the temperature of the first load 21 corresponding to the resistance value. If a constant current flows to the first load 21 when the resistance value of the first load 21 is acquired, the current sensor 55 is unnecessary in the temperature detection element T2. Similarly, if a constant voltage is applied to the first load 21 when the resistance value of the first load 21 is acquired, the voltage sensor 54 is unnecessary in the temperature detection element T2.

(MCU)

Next, a function of the MCU 50 will be described. The MCU 50 includes a temperature detection unit, a power control unit, and a notification control unit as functional blocks implemented by executing programs stored in a ROM by the processor.

The temperature detection unit acquires the temperature of the flavor source 33 based on output of the temperature detection element T1 (or the temperature detection element T3). The temperature detection unit acquires the temperature of the first load 21 based on output of the temperature detection element T2.

The notification control unit controls the first notification unit 45 and the second notification unit 46 to notify various types of information. For example, in response to detection of replacement timing of the second cartridge 30, the notification control unit controls at least one of the first notification unit 45 and the second notification unit 46 to perform a notification that prompts replacement of the second cartridge 30. The notification control unit is not limited to cause the notification that prompts the replacement of the second cartridge 30 to be performed, and may also cause a notification that prompts replacement of the first cartridge 20, a notification that prompts replacement of the power supply 12, a notification that prompts charging of the power supply 12, and the like to be performed.

The power control unit controls discharging from the power supply 12 to the first load 21 and the second load 31 (discharging necessary for heating the load) in response to a signal indicating the aerosol generation request output from the intake sensor 15. That is, the power control unit performs first discharging from the power supply 12 to the first load 21 in order to atomize the aerosol source 22, and second discharging from the power supply 12 to the second load 31 in order to heat the flavor source 33.

Accordingly, in the aerosol generation device 1, the flavor source 33 can be heated by discharging to the second load 31. In order to increase an amount of the flavor component added to the aerosol, it is experimentally found that it is effective to increase an amount of aerosol generated from the aerosol source 22 and to increase the temperature of the flavor source 33.

A weight [mg] of aerosol that is generated in the first cartridge 20 and passes through the flavor source 33 due to one inhalation operation of the user is referred to as an aerosol weight $W_{aerosol}$. Power required to be supplied to the first load 21 for generating the aerosol is referred to as atomization power $P_{liquid}$. A time during which the atomization power $P_{liquid}$ is supplied to the first load 21 for generating the aerosol is referred to as a supply time $t_{sense}$. An upper limit per inhalation of the supply time $t_{sense}$ is the above-described upper limit value $t_{upper}$. A weight [mg] of a flavor component contained in the flavor source 33 is referred to as a flavor component remaining amount $W_{capsule}$. Information on the temperature of the flavor source 33 is referred to as a temperature parameter $T_{capsule}$. A weight [mg] of a flavor component added to the aerosol that passes through the flavor source 33 due to one inhalation operation of the user is referred to as a flavor component amount $W_{flavor}$. Specifically, the information on the temperature of the flavor source 33 is the temperature of the flavor source 33 acquired based on the output of the temperature detection element T1 (or the temperature detection element T3).

It is experimentally found that the flavor component amount $W_{flavor}$ depends on the flavor component remaining amount $W_{capsule}$, the temperature parameter $T_{capsule}$, and the aerosol weight $W_{aerosol}$. Therefore, the flavor component amount $W_{flavor}$ can be modeled by the following Equation (1).

$$W_{flavor}=\beta\times(W_{capsule}\times T_{capsule})\times\gamma\times W_{aerosol} \quad (I)$$

The β in Equation (1) is a coefficient indicating a ratio of how much of the flavor component contained in the flavor source 33 is added to aerosol during one inhalation, and is experimentally obtained. The γ in Equation (1) is a coefficient obtained experimentally. Although the temperature parameter $T_{capsule}$ and the flavor component remaining amount $W_{capsule}$ may fluctuate during a period in which one inhalation is performed, the γ is introduced in the model so as to handle the temperature parameter $T_{capsule}$ and the flavor component remaining amount $W_{capsule}$ as constant values.

The flavor component remaining amount $W_{capsule}$ is decreased every time the inhalation is performed. Therefore, the flavor component remaining amount $W_{capsule}$ is inversely proportional to the number of times of inhalation, which is the number of times when the inhalation is performed. In other words, the number of times of inhalation is the cumulative number of times of discharging operations to the first load 21 for aerosol generation in response to the aerosol generation request. In addition, the flavor component remaining amount $W_{capsule}$ decreases more as a time during which discharging to the first load 21 is performed for the aerosol generation in response to the inhalation becomes longer. Therefore, the flavor component remaining amount $W_{capsule}$ is also inversely proportional to a cumulative value of the time during which the discharging to the first load 21 is performed for the aerosol generation in response to the inhalation (hereinafter, referred to as a cumulative discharging time).

As can be seen from the model of Equation (1), when it is assumed that the aerosol weight $W_{aerosol}$ per inhalation is controlled to be substantially constant, it is necessary to increase the temperature of the flavor source 33 in accordance with a decrease in the flavor component remaining amount $W_{capsule}$ (increase in the number of times of inhalation or the cumulative discharging time) in order to stabilize the flavor component amount $W_{flavor}$.

Therefore, the power control unit of the MCU 50 increases a target temperature of the flavor source 33 (a target temperature $T_{cap_target}$ described below) based on the number of times of inhalation or the cumulative discharging time. Then, the power control unit of the MCU 50 controls discharging for heating the flavor source 33 from the power supply 12 to the second load 31 based on the output of the temperature detection element T1 (or the temperature detection element T3) such that the temperature of the flavor source 33 converges to the target temperature. Accordingly, it is possible to increase and stabilize the flavor component amount $W_{flavor}$. Specifically, the power control unit of the MCU 50 manages the target temperature in accordance with a table stored in advance in the memory 50*a*. The table stores the number of times of inhalation or the cumulative discharging time in association with the target temperature of the flavor source 33.

In the aerosol generation device 1, an amount of a fluid transported per unit time to the mouth of the user due to the inhalation is referred to as a fluid amount Wf. The fluid amount Wf is a sum value of an air amount, an aerosol amount, and the flavor component amount. A ratio of the flavor component amount to the fluid amount Wf is referred to as a flavor concentration Ct.

In the aerosol generation device 1, on a premise that a flow rate of the inhalation of the user is a first predetermined value (for example, 1100 ml/min), the target temperature of the flavor source 33 corresponding to the number of times of inhalation or the cumulative discharging time and the atomization power $P_{liquid}$ supplied to the first load 21 for aerosol generation during one inhalation are determined in such a manner that the flavor concentration Ct becomes a target value. A reference value of the atomization power $P_{liquid}$ determined based on the premise is set as a second predetermined value.

Therefore, when the flow rate of the inhalation of the user is larger than the first predetermined value, the air amount in the fluid amount Wf increases, so that the flavor concentration Ct becomes lower than the target value. In such a case, the flavor concentration Ct can be brought close to the target value by increasing the temperature of the flavor source 33 so as to increase the flavor component amount $W_{flavor}$ in the fluid amount Wf. The flavor concentration Ct can also be brought close to the target value by increasing the atomization power $P_{liquid}$ from the second predetermined value so as to increase the aerosol weight $W_{aerosol}$ in the fluid amount Wf.

As described above, the power control unit of the MCU 50 controls the power to be discharged to the second load 31 and the first load 21 based on the flow rate of the inhalation of the user such that the flavor concentration Ct becomes the target value regardless of magnitude of the flow rate of the inhalation.

(Operation of Aerosol Generation Device)

Figure 7:
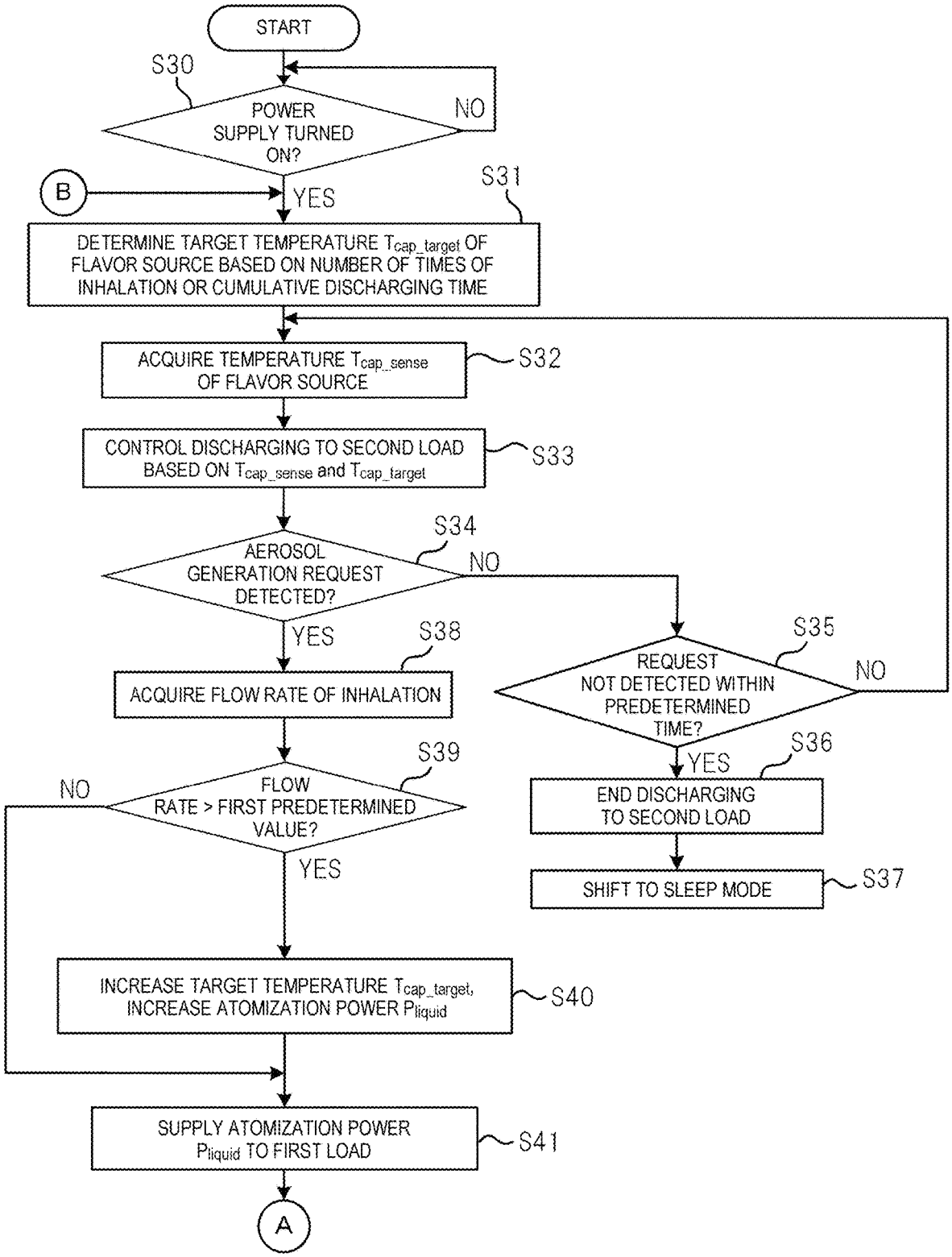
FIG. 7 is a flowchart for explaining an operation of the aerosol generation device shown in FIG. 1.
Figure 8:
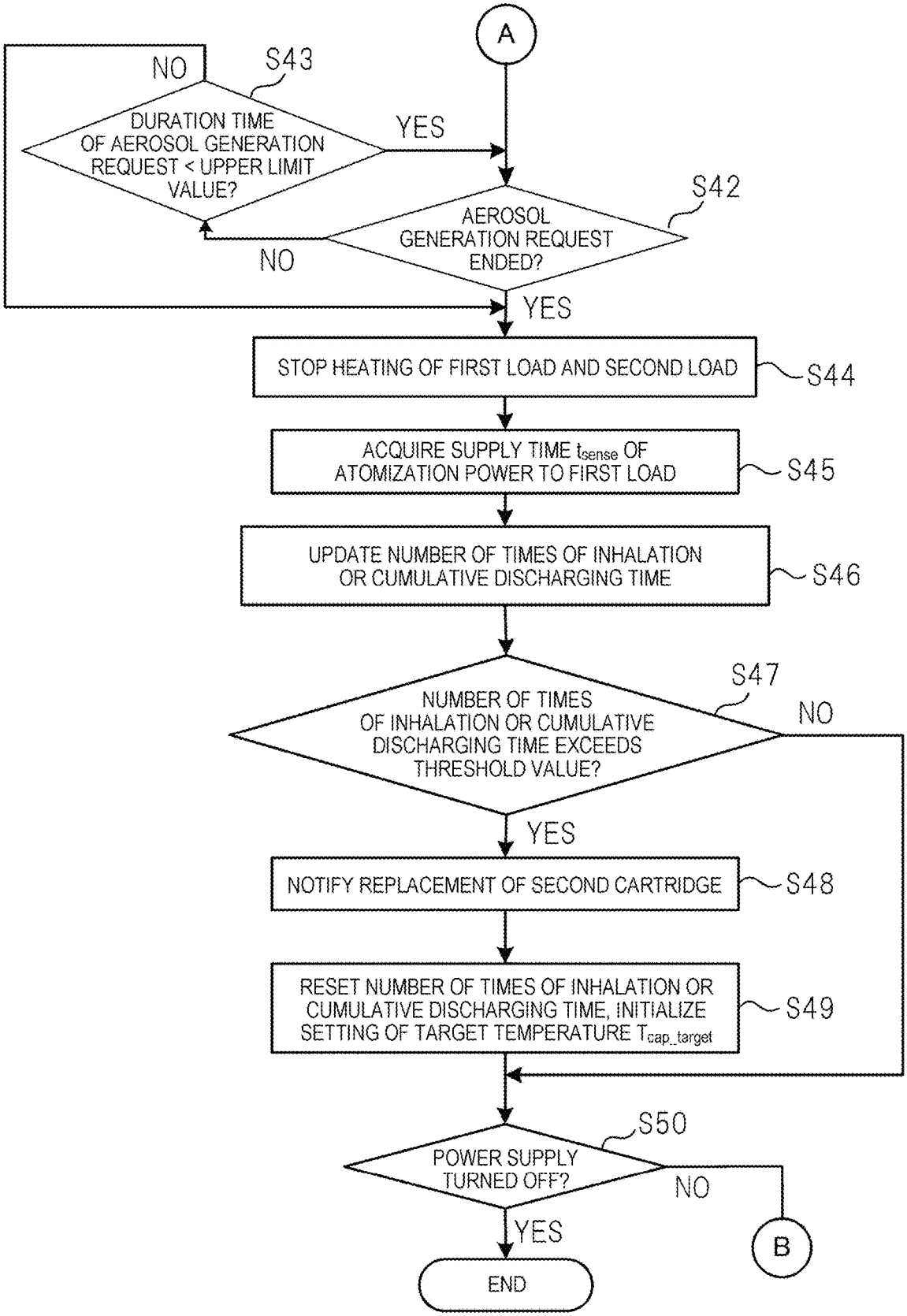
FIG. 8 is a flowchart for explaining the operation of the aerosol generation device shown in FIG. 1.

FIGS. 7 and 8 are flowcharts for explaining an operation of the aerosol generation device 1 shown in FIG. 1. When the power supply of the aerosol generation device 1 is turned on by an operation of the operation unit 14 or the like (step S30: YES), the MCU 50 determines (sets) the target temperature $T_{cap_target}$ of the flavor source 33 based on the number of times of inhalation or the cumulative discharging time stored in the memory 50*a* (step S31).

Next, the MCU 50 acquires the current temperature $T_{cap_sense}$ of the flavor source 33 based on the output of the temperature detection element T1 (or the temperature detection element T3) (step S32).

The MCU 50 controls discharging to the second load 31 for heating the flavor source 33 based on the temperature $T_{cap_sense}$ and the target temperature $T_{cap_target}$ (step S33). Specifically, the MCU 50 supplies power to the second load 31 by proportional-integral-differential (PID) control or ON/OFF control such that the temperature $T_{cap_sense}$ converges to the target temperature $T_{cap_target}$.

In the PID control, a difference between the temperature $T_{cap_sense}$ and the target temperature $T_{cap_target}$ is fed back, and power control is performed based on a feedback result thereof such that the temperature $T_{cap_sense}$ converges to the target temperature $T_{cap_target}$. According to the PID control, the temperature $T_{cap_sense}$ can converge to the target temperature $T_{cap_target}$ with high accuracy. The MCU 50 may also use proportional (P) control or proportional-integral (PI) control instead of the PID control.

The ON/OFF control is control in which power is supplied to the second load 31 in a state where the temperature $T_{cap_sense}$ is lower than the target temperature $T_{cap_target}$, and the power supply to the second load 31 is stopped until the temperature $T_{cap_sense}$ becomes lower than the target temperature $T_{cap_target}$ in a state where the temperature $T_{cap_sense}$ is equal to or higher than the target temperature $T_{cap_target}$. According to the ON/OFF control, the temperature of the flavor source 33 can be increased faster than the PID control. Therefore, it is possible to increase a possibility that the temperature $T_{cap_sense}$ reaches the target temperature $T_{cap_target}$ at a stage before an aerosol generation request described later is detected.

After step S33, the MCU 50 determines presence or absence of the aerosol generation request (step S34). When the aerosol generation request is not detected (step S34: NO), the MCU 50 determines a length of a time during which the aerosol generation request is not made (hereinafter, referred to as a non-operation time) in step S35. When the non-operation time reaches a predetermined time (step S35: YES), the MCU 50 ends discharging to the second load 31 (step S36), and performs shifting to a sleep mode in which power consumption is reduced (step S37). When the non-operation time is less than the predetermined time (step S35: NO), the MCU 50 shifts the process to step S32.

When the aerosol generation request is detected (step S34: YES), the MCU 50 acquires a flow rate of a fluid inhaled by the user (step S38), and determines whether the acquired flow rate exceeds the first predetermined value (step S39).

When the flow rate is equal to or lower than the first predetermined value (step S39: NO), the MCU 50 shifts the process to step S41. When the flow rate exceeds the first predetermined value (step S39: YES), the MCU 50 executes a process of increasing the target temperature $T_{cap_target}$ determined in step S31 and increasing a set value of the atomization power $P_{liquid}$ from the second predetermined value determined in advance according to the above-described premise (step S40).

The memory 50*a* stores a table in which a difference ΔF between the flow rate and the first predetermined value, a temperature increase amount ΔT of the target temperature $T_{cap_target}$, and a power increase amount ΔP of the atomization power $P_{liquid}$ are associated with each other. As described above, this table is generated in such a manner that the flavor concentration Ct becomes the target value.

In step S40, the MCU 50 obtains the difference ΔF by subtracting the first predetermined value from the flow rate acquired in step S38, reads the temperature increase amount ΔT and the power increase amount ΔP corresponding to the difference ΔF from the table, and increases the target temperature and the atomization power according to the read data. Since the target temperature is increased in step S40, the temperature of the flavor source 33 is increased as compared with a time point immediately before the detection of the aerosol generation request.

After step S40, the MCU 50 shifts the process to step S41. In step S41, the MCU 50 supplies the atomization power $P_{liquid}$ to the first load 21 to heat the first load 21 (heating for atomizing the aerosol source 22), and starts aerosol generation. Here, the atomization power $P_{liquid}$ supplied to the first load 21 becomes the second predetermined value when the determination in step S39 is NO, and becomes "the second predetermined value+ΔP" when the determination in step S39 is YES.

After the heating of the first load 21 is started in step S41, when the aerosol generation request is ended (step S42: NO), and if a duration time of the aerosol generation request is less than the upper limit value $t_{upper}$ (step S43: YES), the MCU 50 continues the heating of the first load 21. When the duration time of the aerosol generation request reaches the upper limit value $t_{upper}$ (step S43: NO) and when the aerosol generation request is ended (step S42: YES), the MCU 50 stops the power supply to the first load 21 and the second load 31 (step S44).

After step S44, the MCU 50 acquires the supply time $t_{sense}$ of the atomization power $P_{liquid}$ supplied to the first load 21 during the heating of the first load 21 started in step S41 (step S45). Then, the MCU 50 updates the number of times of inhalation or the cumulative discharging time stored in the memory 50*a* (step S46).

The cumulative discharging time is updated by adding the supply time $t_{sense}$ acquired in step S45 to a cumulative value of the supply time $t_{sense}$ until an inhalation last time. The number of times of inhalation is updated by advancing a counter value of a counter incorporated in the MCU 50 by one.

Next, the MCU 50 determines whether the updated number of times of inhalation or the updated cumulative discharging time exceeds a threshold value (step S47). When the updated number of times of inhalation or the updated cumulative discharging time is equal to or lower than the threshold value (step S47: NO), the MCU 50 shifts the process to step S50.

When the updated number of times of inhalation or the updated cumulative discharging time exceeds the threshold value (step S47: YES), the MCU 50 causes the first notification unit 45 and the second notification unit 46 to perform notification that prompts replacement of the second cartridge 30 (step S48). Then, the MCU 50 resets the number of times of inhalation or the cumulative discharging time of the memory 50*a* to an initial value (=0), and initializes the target temperature $T_{cap_target}$ (step S49). The initialization of the target temperature $T_{cap_target}$ means that the target temperature $T_{cap_target}$ stored in the memory 50*a* at that time point is excluded from a set value.

After step S49, if the power supply is not turned off (step S50: NO), the MCU 50 returns the process to step S31, and if the power supply is turned off (step S50: YES), the MCU 50 ends the process.

(Effect of Embodiment)

As described above, according to the aerosol generation device 1, the amount of the flavor component added to the aerosol can be stabilized at a high value, and thus commercial value thereof can be increased.

In addition, according to the aerosol generation device 1, even if the flow rate of the inhalation of the user exceeds the first predetermined value, the temperature of the flavor source 33 and the power supplied to the first load 21 for aerosol generation are increased based on the flow rate. Therefore, even when an inhalation stronger than an inhalation operation assumed by the device is performed, the flavor concentration Ct can be maintained at the target value.

As a result, a desired flavor can be provided to the user regardless of differences in the inhalation operation of the user.

Although both the increase in the target temperature and the increase in the atomization power are performed in step S40 shown in FIG. 7, a configuration in which only the target temperature is increased may be employed. In this configuration, a table in which the difference ΔF between the flow rate and the first predetermined value and the temperature increase amount ΔT of the target temperature $T_{cap_target}$ are associated with each other is stored in the memory 50*a*. This table is generated in such a manner that the flavor concentration Ct becomes the target value. The MCU 50 may increase the target temperature in accordance with the table. With this configuration, the flavor concentration Ct can still be maintained at the target value, and the desired flavor can still be provided to the user.

In the case where only the target temperature is increased in step S40, it is necessary to increase magnitude of the increase in the target temperature even when the flow rate is the same as compared with the case where both the increase in the target temperature and the increase in the atomization power are performed. That is, according to the configuration in which both the increase in the target temperature and the increase in the atomization power are performed, the magnitude of the increase in the target temperature can be reduced. By reducing the magnitude of the increase in the target temperature in this way, the temperature of the flavor source 33 can easily reach the target temperature at an early stage. As a result, the flavor concentration Ct can be converged to the target value at an early stage of the inhalation, and a stable flavor can be provided to the user from a start of the inhalation to an end of the inhalation.

Alternatively, in step S40 shown in FIG. 7, the process of increasing both the target temperature and the atomization power and the process of increasing only the target temperature may be selected based on magnitude of the flow rate. For example, when the difference ΔF is equal to or less than a threshold value and the flavor concentration Ct can be set to the target value only by increasing the temperature of the flavor source 33, the MCU 50 only increases the target temperature. On the other hand, when the difference ΔF exceeds the threshold value and it is difficult to set the flavor concentration Ct to the target value only by increasing the temperature of the flavor source 33, the MCU 50 increases both the target temperature and the atomization power. When such a process is performed, a table in which the difference ΔF equal to or less than the threshold value and the temperature increase amount ΔT are associated with each other and a table in which the difference ΔF exceeding the threshold value, the temperature increase amount ΔT, and the power increase amount ΔP are associated with each other are stored in the memory 50*a*. The MCU 50 may increase the target temperature or increase the target temperature and the atomization power by referring to one of the tables according to magnitude of the difference ΔF.

A predetermined range of the flow rate centered on the first predetermined value may be set, and a case where the flow rate falls within the predetermined range may be set as the premise. In this case, during the determination of step S39, if the flow rate at the time of the inhalation is within the predetermined range, the MCU 50 does not increase the target temperature and the atomization power, and if the flow rate at the time of the inhalation exceeds the predetermined range, the MCU 50 obtains a difference between a maximum value of the predetermined range and the flow rate as the difference ΔF, and increases the target temperature and the atomization power according to the difference ΔF.

(First Modification of Aerosol Generation Device)

Figure 9:
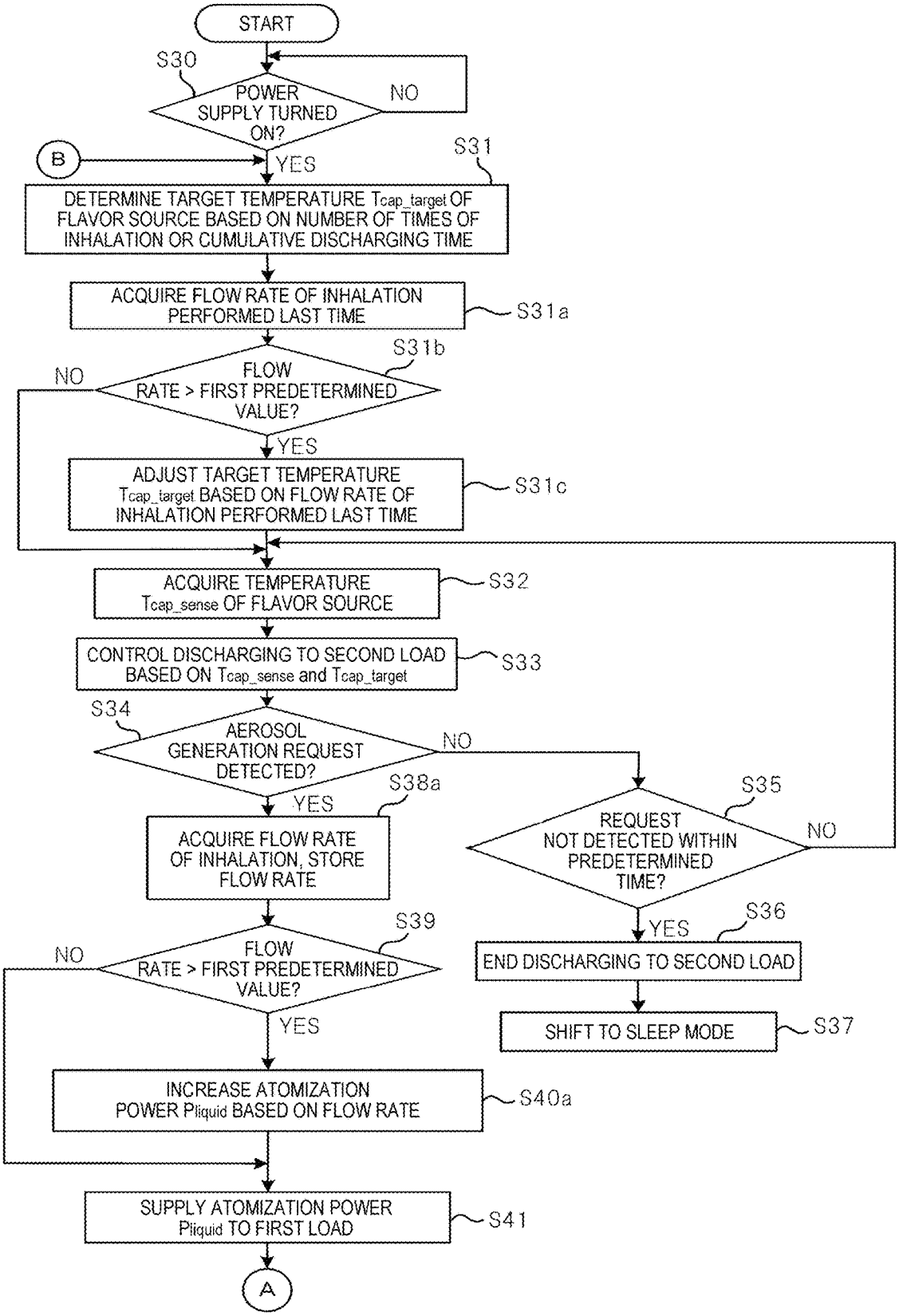
FIG. 9 is a flowchart for explaining a first modification of the operation of the aerosol generation device shown in FIG. 1.

FIG. 9 is a flowchart for explaining a first modification of the operation of the aerosol generation device 1 shown in FIG. 1. Since processes of step S41 and subsequent steps shown in FIG. 9 are the same as those shown in FIG. 8, an illustration thereof is omitted. FIG. 9 is the same as FIG. 7 except that step S31*a*, step S31*b*, and step S31*c* are added between step S31 and step S32, step S38 is changed to step S38*a*, and step S40 is changed to step S40*a*. Hereinafter, changes as compared with FIG. 7 will be mainly described.

In step S31*a* subsequent to step S31, the MCU 50 acquires, from the memory 50*a*, information on the flow rate of the inhalation of the user performed last time. In the next step S31*b*, the MCU 50 determines whether the flow rate at the time of the inhalation last time exceeds the first predetermined value.

When the flow rate at the time of the inhalation last time exceeds the first predetermined value (step S31*b*: YES), the MCU 50 adjusts the target temperature $T_{cap_target}$ determined in step S31 based on the flow rate (step S31*c*). When the aerosol generation device 1 is used for the first time, the flow rate at the time of the inhalation last time is not stored in the memory 50*a*. Therefore, in this case, the processes of step S31*a*, step S31*b*, and step S31*c* are omitted.

The memory 50*a* stores the table in which the difference ΔF between the flow rate and the first predetermined value, the temperature increase amount ΔT of the target temperature $T_{cap_target}$, and the power increase amount ΔP of the atomization power $P_{liquid}$ are associated with each other. In step S31*c*, the MCU 50 calculates the difference ΔF by subtracting the first predetermined value from the flow rate at the time of the inhalation last time. Further, the MCU 50 reads the temperature increase amount ΔT corresponding to the difference ΔF from the table, and adds the read temperature increase amount ΔT to the target temperature determined in step S31 to adjust the target temperature. When the determination in step S31*b* is NO and after step S31*c*, the process of step S32 is performed.

When the aerosol generation request is detected in step S34 (step S34: YES), the MCU 50 acquires the flow rate of the inhalation of the user this time, and stores the flow rate in the memory 50*a* as information on the latest flow rate (step S38*a*). The latest flow rate stored here is the flow rate at the time of the inhalation last time acquired in the process of step S31*a* next time.

In step S39 after step S38*a*, the MCU 50 determines whether the flow rate acquired in step S38*a* exceeds the first predetermined value. When the flow rate acquired in step S38*a* exceeds the first predetermined value (step S39: YES), the MCU 50 acquires the power increase amount ΔP corresponding to the difference between the flow rate and the first predetermined value from the above table. Then, the MCU 50 increases the atomization power by changing a set value of the atomization power $P_{liquid}$ to a sum value of the acquired power increase amount ΔP and the second predetermined value (step S40*a*). When the determination in step S39 is NO, and after the process of step S40*a*, processes of step S41 and subsequent steps are performed.

According to the operation of the first modification described above, before the detection of the inhalation of the user, the target temperature of the flavor source 33 is adjusted based on the flow rate at the time of the inhalation last time, and control of discharging from the power supply 12 to the second load 31 is started such that the temperature of the flavor source 33 converges to the target temperature.

Therefore, it is possible to control the temperature of the flavor source 33 so as to set the flavor concentration Ct to the target value at a stage before the inhalation.

Instead of being directly heated by the second load 31, the flavor source 33 is indirectly heated via an exterior body of the second cartridge 30. Therefore, it may take time to increase the temperature of the flavor source 33 to a desired value. As described above, even when temperature responsiveness of the flavor source 33 is low, by adjusting the target temperature based on the flow rate at the time of the inhalation last time and performing control to converge the temperature of the flavor source 33 to the target temperature before the aerosol generation, the temperature of the flavor source 33 can be brought close to an optimum temperature of the flavor source 33 according to the flow rate at the time of the inhalation at a time point when the inhalation of the user is started. There is no large difference between the flow rate of the inhalation last time and the flow rate of the inhalation this time on the assumption that the inhalation is performed by the same user. Therefore, by controlling the temperature of the flavor source 33 based on the flow rate at the time of the inhalation last time, it is possible to provide the user with a flavor close to a target from an early stage of the start of the inhalation.

In the operation of the first modification, the flow rate used to adjust the temperature of the flavor source 33 and the flow rate used to adjust the atomization power are acquired at different timings. However, there is no large difference between the flow rate of the inhalation last time and the flow rate of the inhalation this time. Therefore, even when there is a difference between the flow rate at the time of the inhalation this time and the flow rate at the time of the inhalation last time, it is possible to reduce deviation between an optimum target temperature and an optimum atomization power (target temperature and atomization power necessary for setting the flavor concentration Ct to the target value) corresponding to the flow rate at the time of the inhalation this time and the target temperature after the increase in step S31*c* and the atomization power after the increase in step S40*a*. As a result, the target flavor can be provided to the user.

The operation of the first modification can also be modified to an operation in which step S39 and step S40*a* are deleted and the process proceeds to step S41 after step S38*a*. According to this operation, the temperature of the flavor source 33 is adjusted based on the flow rate of the inhalation last time before a next inhalation is started. Therefore, it is possible to provide the user with the flavor close to the target from the early stage of the start of the inhalation.

In the operation of the first modification, when the flow rate is high during a first inhalation in the aerosol generation device 1, only the atomization power is increased. However, before a next inhalation is started, the target temperature is increased according to the flow rate at that time. Therefore, when the flow rate is large at the time of the next inhalation, the temperature of the flavor source 33 is increased and an amount of generated aerosol is increased, and thus the flavor concentration Ct can be brought close to the target value.

(Second Modification of Aerosol Generation Device)

Figure 10:
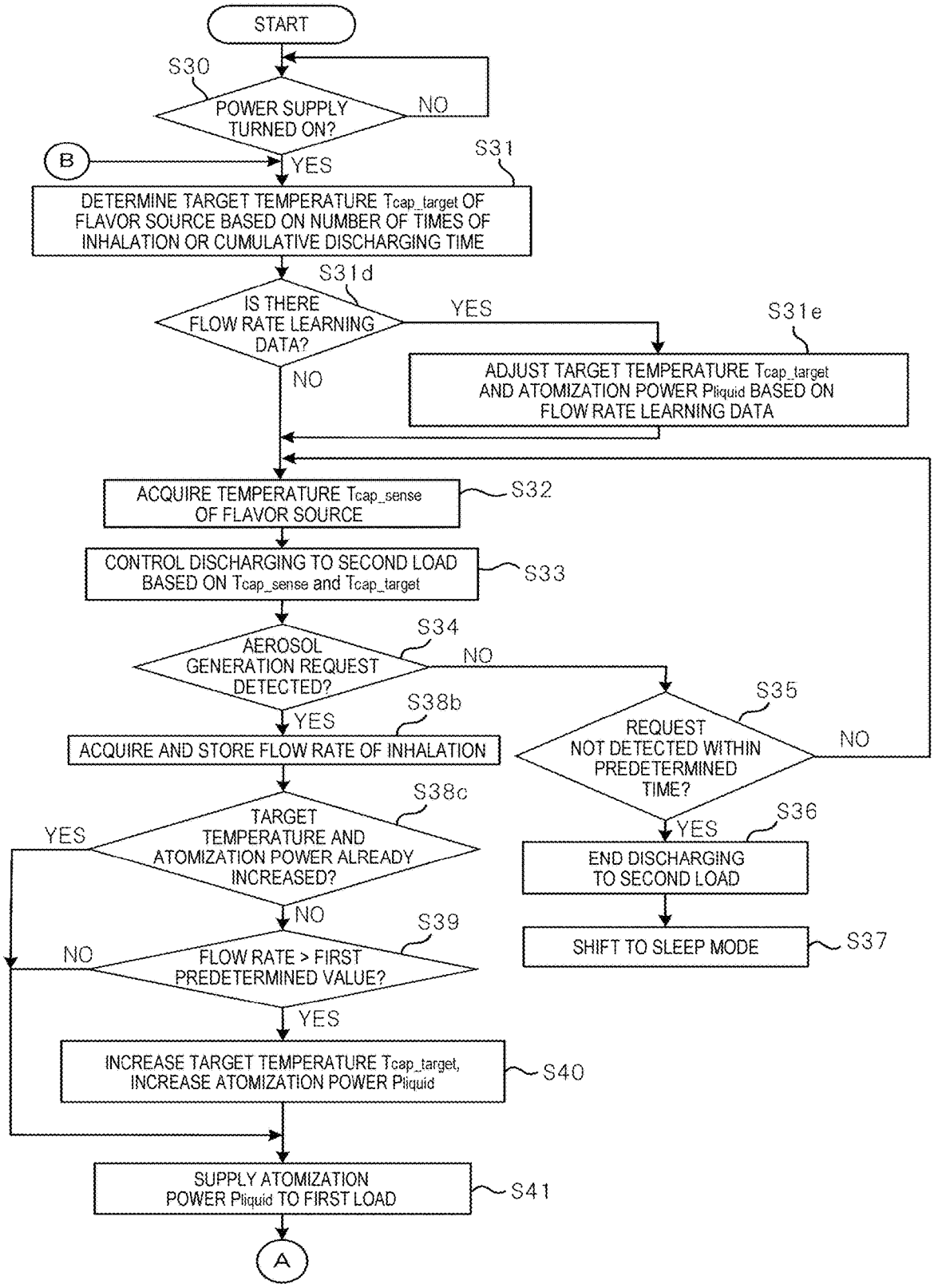
FIG. 10 is a flowchart for explaining a second modification of the operation of the aerosol generation device shown in FIG. 1.

FIG. 10 is a flowchart for explaining a second modification of the operation of the aerosol generation device 1 shown in FIG. 1. Since processes of step S41 and subsequent steps shown in FIG. 10 are the same as those shown in FIG. 8, an illustration thereof is omitted. FIG. 10 is the same as FIG. 7 except that step S31*d* and step S31*e* are added between step S31 and step S32, and step S38 is changed to step S38*b* and step S38*c*. Hereinafter, changes as compared with FIG. 7 will be mainly described.

In step S31*d* after step S31, the MCU 50 determines whether flow rate learning data is already stored in the memory 50*a*. The flow rate learning data is data that is generated based on information on flow rates during a plurality of past times of inhalation of the user performed before the last time, and indicates a tendency of the inhalation operation of the user. For example, an average value, a median value, or a mode value of the flow rates during the plurality of past times of inhalation can be generated as the flow rate learning data. The flow rate learning data is not generated until a predetermined number (=a natural number equal to or higher than 2) of flow rates are acquired, that is, until the inhalation is performed for the predetermined number of times. In step S38*b* described later, when the flow rates corresponding to the predetermined number of times or more are acquired, the MCU 50 generates the flow rate learning data based on the flow rates corresponding to the predetermined number of times and stores the flow rate learning data in the memory 50*a*.

When the flow rate learning data is already stored in the memory 50*a* (step S31*d*: YES), the MCU 50 performs a adjustment process of the target temperature and the atomization power determined in step S31 based on the flow rate learning data (step S31*e*).

Specifically, when the flow rate learning data is equal to or less than the first predetermined value, the MCU 50 maintains the target temperature determined in step S31 without changing, and sets the atomization power to the second predetermined value. When the flow rate learning data exceeds the first predetermined value, the MCU 50 calculates the difference ΔF by subtracting the first predetermined value from the flow rate learning data. Then, based on the difference ΔF and the table, the MCU 50 increases the target temperature determined in step S31 by the temperature increase amount ΔT, and increases the atomization power from the second predetermined value by the power increase amount ΔP. When the determination in step S31*d* is NO and after the process of step S31*e*, the process of step S32 is performed.

When the aerosol generation request is detected in step S34 (step S34: YES), the MCU 50 acquires the flow rate of the inhalation of the user this time, and stores the flow rate in the memory 50*a* (step S38*b*). In step S38*b*, when information on a required number or more of flow rates is stored in the memory 50*a*, the MCU 50 generates the flow rate learning data based on all the flow rates already stored in the memory 50*a*, and stores the flow rate learning data in the memory 50*a*.

In step S38*c* subsequent to step S38*b*, the MCU 50 determines whether the target temperature determined in step S31 and the atomization power are increased. When the target temperature and the atomization power are increased in step S31*e* (step S38*c*: YES), the MCU 50 performs the process of step S41.

When the target temperature and the atomization power are not increased (step S38*c*: NO), the MCU 50 determines whether the flow rate at the time of the inhalation this time acquired in step S38*b* exceeds the first predetermined value (step S39).

When the flow rate acquired in step S38*b* exceeds the first predetermined value (step S39: YES), the MCU 50 acquires the temperature increase amount ΔT and the power increase amount ΔP corresponding to the difference between the flow rate and the first predetermined value from the above table. Then, the MCU 50 increases the target temperature and the atomization power based on the temperature increase amount ΔT and the power increase amount ΔP (step S40). When the determination in step S39 is NO, and after the process of step S40, the process of step S41 is performed.

According to the operation of the second modification described above, before the inhalation of the user is detected, the target temperature of the flavor source 33 and the atomization power are adjusted based on the flow rates during the plurality of past times of inhalation before the last time. Therefore, it is possible to control the temperature of the flavor source 33 so as to set the flavor concentration Ct to the target value at a stage before the inhalation. In addition, since the adjustment of the atomization power is also ended at the stage before the inhalation, supply of the atomization power supplied to the first load 21 for setting the flavor concentration Ct to the target value can be started immediately after the inhalation is started. As a result, a desired flavor can be provided to the user at an early stage after the inhalation. In addition, since the target temperature and the atomization power are adjusted according to the flow rate learning data based on the flow rates of the plurality of past times, adjustment accuracy of the target temperature can be improved as compared with the operation of the first modification.

(Third Modification of Aerosol Generation Device)

So far, in the description, at least one of the target temperature and the atomization power is increased based on the flow rate of the inhalation of the user in order to prevent the flavor concentration Ct from decreasing when the flow rate is increased. However, when the flow rate of the inhalation of the user is less than the first predetermined value (when an inhalation that is weaker than that assumed by the device is performed), the air amount in the fluid amount Wf decreases, and thus the flavor concentration Ct becomes higher than the target value. In order to improve commercial value of the aerosol generation device 1, it is necessary to at least avoid the decrease in the flavor concentration Ct. That is, a situation where the flavor concentration Ct is higher than the target value can be allowed. However, in order to further increase the commercial value of the aerosol generation device 1, it is preferable to control the flavor concentration Ct to be the target value by performing at least one of a decrease in the target temperature and a decrease in the atomization power when the flow rate of the inhalation of the user is less than the first predetermined value.

For example, in the case of the operation shown in FIG. 7, when the determination in step S39 is NO and the flow rate is less than the first predetermined value, it is preferable to reduce the target temperature and the atomization power based on the difference between the flow rate and the first predetermined value.

In the aerosol generation device 1 described so far, at least one of the target temperature and the atomization power is increased based on the flow rate per inhalation. As a modification, at least one of the target temperature and the atomization power may be controlled based on a cumulative value of the flow rate of the inhalation of the user. For example, when the cumulative value of the flow rate is more than the premise, at least one of the target temperature and the atomization power may be increased to control the flavor concentration to be the target value. In this modification, by resetting the cumulative value of the flow rate to 0 at a time point when a remaining amount of the flavor source 33 is depleted, it is possible to perform appropriate control according to a manner of the inhalation of the user who is consuming one second cartridge 30. Alternatively, by resetting the cumulative value of the flow rate to 0 at a time point when a remaining amount of the aerosol source 22 is depleted, it is possible to perform appropriate control according to the manner of the inhalation of the user who is consuming one first cartridge 20.

In the aerosol generation device 1 described so far, the target temperature of the flavor source 33 is set based on the number of times of inhalation or the cumulative discharging time. As described above, the number of times of inhalation or the cumulative discharging time is a parameter inversely proportional to the remaining amount of the flavor component included in the flavor source 33. Therefore, the flavor component remaining amount of the flavor source 33 may be derived by calculation based on a parameter such as an amount of power supplied to the first load 21 for aerosol generation, and the target temperature of the flavor source 33 may be set based on the flavor component remaining amount.

In the aerosol generation device 1 described so far, the first load 21 may be constituted by an element that can atomize the aerosol source 22 by ultrasonic waves or the like without heating the aerosol source 22. An element that can be used for the first load 21 is not limited to the heater and the ultrasonic wave element described above, and various elements or combinations thereof can be used as long as the element can atomize the aerosol source 22 by consuming the power supplied from the power supply 12.

In the present specification, at least the following matters are described. Although corresponding constituent elements or the like in the above-described embodiment are shown in parentheses, the present invention is not limited thereto.

(1) A power supply unit (power supply unit 10) for an aerosol generation device (aerosol generation device 1) through which flavored aerosol is inhaled, the power supply unit includes:

a power supply (power supply 12) configured to discharge electricity to an atomizer (first load 21) configured to atomize an aerosol source (aerosol source 22) and a heater (second load 31) configured to heat a flavor source (flavor source 33) that adds a flavor component to aerosol generated from the aerosol source; and a processing device (processor of the MCU 50) configured to acquire a flow rate of inhalation of a user.

When the inhalation of the user is detected, the processing device discharges electricity from the power supply to the atomizer so as to generate aerosol.

The processing device controls power to be discharged to the heater based on the flow rate such that a concentration (flavor concentration Ct) of a flavor component contained in a fluid inhaled by the user becomes a target value.

According to (1), since the power discharged to the heater is controlled based on the flow rate of the inhalation of the user, even if there is a difference in a manner of the inhalation of the user, the user can be provided with a constant flavor. The "flavor component contained in the fluid inhaled by the user" may contain not only the flavor component contained in the flavor source but also a flavor component contained in the aerosol source.

(2) The power supply unit for an aerosol generation device according to (1), in which before the detection of the inhalation of the user, the processing device starts control of discharging from the power supply to the heater such that a temperature of the flavor source converges to a target temperature, and when the inhalation of the user is detected, the processing device adjusts the target temperature based on the flow rate at the time of the inhalation.

According to (2), the target temperature is adjusted during the inhalation of the user, and the power discharged to the heater is controlled. Therefore, the flavor can be brought into a target state at an early stage.

(3) The power supply unit for an aerosol generation device according to (2), in which when the flow rate at the time of the inhalation exceeds a reference value (first predetermined value), the processing device increases the target temperature.

According to (3), when the flow rate of the inhalation is high, the temperature of the flavor source is increased. Therefore, the flavor component in the fluid transported to a mouth of the user can be increased, and the target flavor can be provided to the user.

(4) The power supply unit for an aerosol generation device according to (1), in which before the detection of the inhalation of the user, the processing device determines a target temperature of the flavor source based on the flow rate at the time of a previous inhalation and starts control of discharging from the power supply to the heater such that a temperature of the flavor source converges to the target temperature.

According to (4), since the control of discharging to the heater is performed according to a record of the inhalation of the user, the temperature of the flavor source can be optimized at a stage before the inhalation. As a result, the target flavor can be provided to the user from an early stage of a start of the inhalation.

(5) The power supply unit for an aerosol generation device according to (4), in which the previous inhalation is an inhalation of a last time.

According to (5), since the target temperature is determined based on the flow rate of the inhalation last time, a process can be simplified.

(6) The power supply unit for an aerosol generation device according to any one of (1) to (5), in which the processing device further controls, based on the flow rate, power to be discharged to the atomizer for aerosol generation such that the concentration becomes the target value.

According to (6), even when the inhalation is performed such that the target flavor cannot be achieved only by controlling the temperature of the flavor source, the target flavor can be achieved by adjusting the amount of generated aerosol.

(7) The power supply unit for an aerosol generation device according to (6), in which the processing device controls power to be supplied to the atomizer for next aerosol generation based on the flow rate at the time of the previous inhalation.

According to (7), the amount of generated aerosol is adjusted based on the flow rate at the time of the previous inhalation. Therefore, the amount of generated aerosol can be optimized at a stage before the inhalation, and the target flavor can be provided to the user from an early stage of the start of the inhalation.

(8) The power supply unit for an aerosol generation device according to (6) or (7), in which when the flow rate exceeds the reference value (first predetermined value), the processing device increases power to be supplied to the atomizer.

According to (8), when the flow rate of the inhalation is high, the amount of generated aerosol is increased, and thus the flavor component added to the aerosol can be increased. By both increasing the flavor component and adjusting the flavor component by controlling the temperature of the flavor source, the target flavor can be provided to the user.

What is claimed is:

1. A power supply unit for an aerosol generation device through which flavored aerosol is inhaled, the power supply unit comprising:

a power supply configured to discharge electricity to an atomizer configured to atomize an aerosol source and a heater configured to heat a flavor source that adds a flavor component to aerosol generated from the aerosol source; and a processing device configured to acquire a flow rate of inhalation of a user, wherein:

when the inhalation of the user is detected, the processing device discharges electricity from the power supply to the atomizer so as to generate aerosol;

the processing device controls power to be discharged to the heater based on the flow rate such that a concentration of a flavor component contained in a fluid inhaled by the user becomes a target value; and before the detection of the inhalation of the user, the processing device determines a target temperature of the flavor source based on the flow rate at the time of a previous inhalation and starts control of discharging from the power supply to the heater such that a temperature of the flavor source converges to the target temperature.

2. The power supply unit for an aerosol generation device according to claim 1, wherein the previous inhalation is an inhalation of a last time.

* * * * *